United States Patent [19]

Ashby

[11] Patent Number: 5,071,399

[45] Date of Patent: Dec. 10, 1991

[54] METHOD OF MAKING A MAILER WITH TEAR STRIP ON OUTGOING AND RETURN ENVELOPES

[75] Inventor: Robert E. Ashby, Quakertown, Pa.

[73] Assignee: Moore Business Forms, Inc., Grand Island, N.Y.

[21] Appl. No.: 482,868

[22] Filed: Feb. 22, 1990

[51] Int. Cl.[5] ..... B31B 27/14

[52] U.S. Cl. ..... 493/216; 53/460

[58] Field of Search ..... 229/69, 73; 493/187, 493/188, 210, 216, 223, 224; 53/450, 460

[56] References Cited

U.S. PATENT DOCUMENTS

| | | | |
|---|---|---|---|
| 2,964,233 | 12/1960 | McFarland . | |
| 3,529,756 | 9/1970 | Smith . | |
| 3,905,545 | 9/1975 | Juszak et al. | 229/69 |
| 3,955,750 | 5/1976 | Huffman . | |
| 3,988,971 | 11/1976 | Steidinger | 493/216 |
| 4,002,290 | 1/1977 | Van Malderghem | 229/69 |
| 4,102,489 | 7/1978 | Lucas . | |
| 4,437,852 | 3/1984 | Volk et al. | 493/216 |
| 4,543,082 | 9/1985 | Stenner | 493/216 |
| 4,632,427 | 12/1986 | Angus | 229/69 X |
| 4,671,454 | 6/1987 | Warren . | |
| 4,709,850 | 12/1987 | Wagner | 229/69 X |
| 4,715,530 | 12/1987 | Leese et al. | 229/73 |
| 4,779,792 | 10/1988 | Lombardo | 229/69 X |
| 4,819,807 | 4/1989 | Giger . | |
| 4,830,269 | 3/1989 | Jenkins | 229/69 X |
| 4,840,306 | 6/1989 | Lombardo | 229/69 X |
| 4,896,823 | 1/1990 | Taylor | 229/69 X |
| 4,955,526 | 9/1990 | Haase et al. | 229/69 |

*Primary Examiner*—William E. Terrell
*Assistant Examiner*—John A. Marlott
*Attorney, Agent, or Firm*—Nixon & Vanderhye

[57] ABSTRACT

A method is provided for constructing a mailer type business form in a continuous manner so that an easy opening tear strip is provided in both the outgoing and return envelopes. This allows not only the addressee of the outgoing envelope to readily remove its contents, but allows the addressor of the outgoing envelope—when the return envelope is received thereby—to readily retrieve the contents of the return envelope. This substantially enhances the utility of the ultimate mailer product. Desirably, the tear strips are formed by a slit and perforation in the bottom sheet of each of the outgoing and return envelopes, and within the mailer the tear strips are parallel to each other. An insert is also typically provided between the top sheet of the outgoing envelope and the top sheet of the return envelope, and is pasted to outgoing envelope at the left and right.

14 Claims, 2 Drawing Sheets

FIG. 2
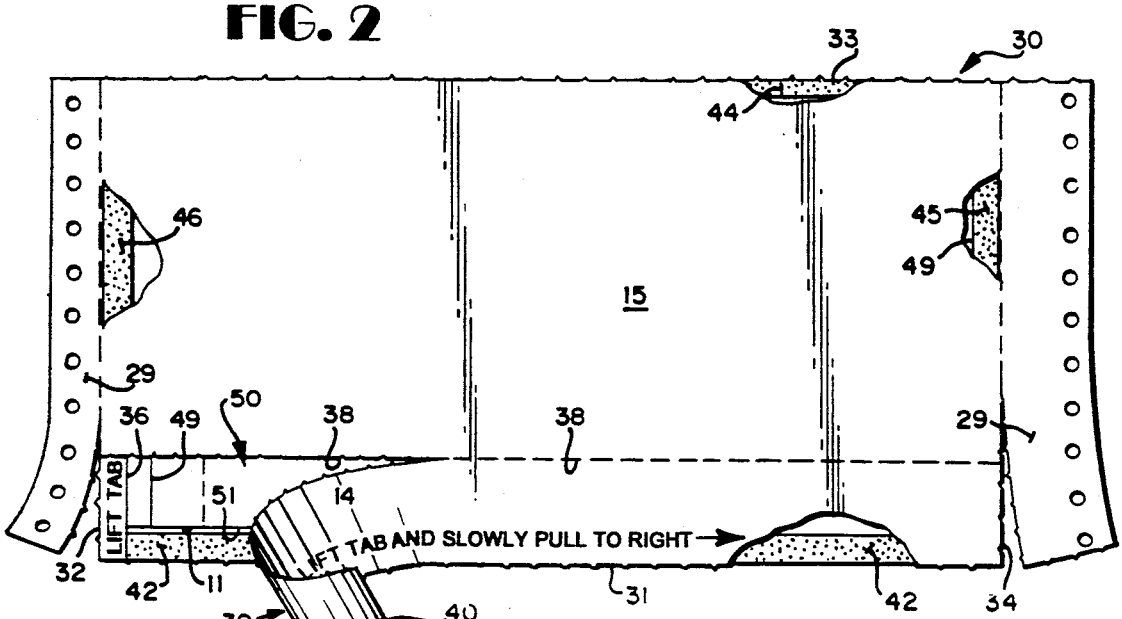
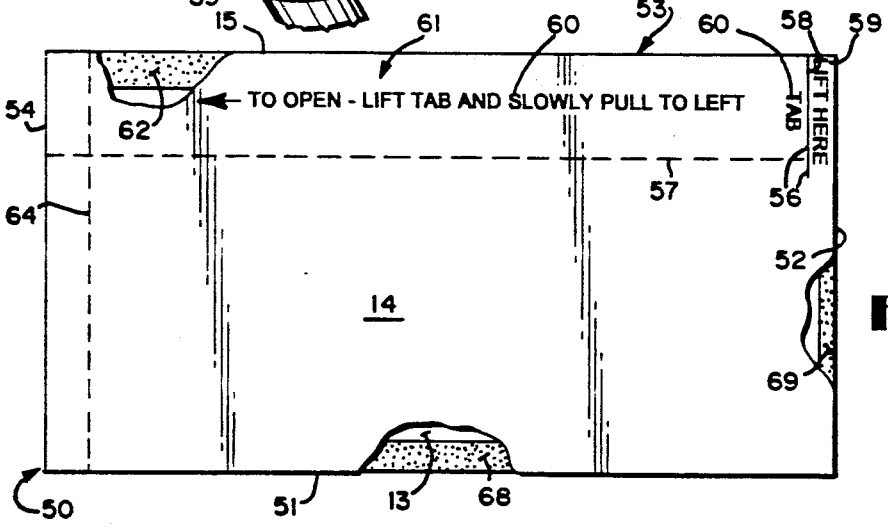
FIG. 3
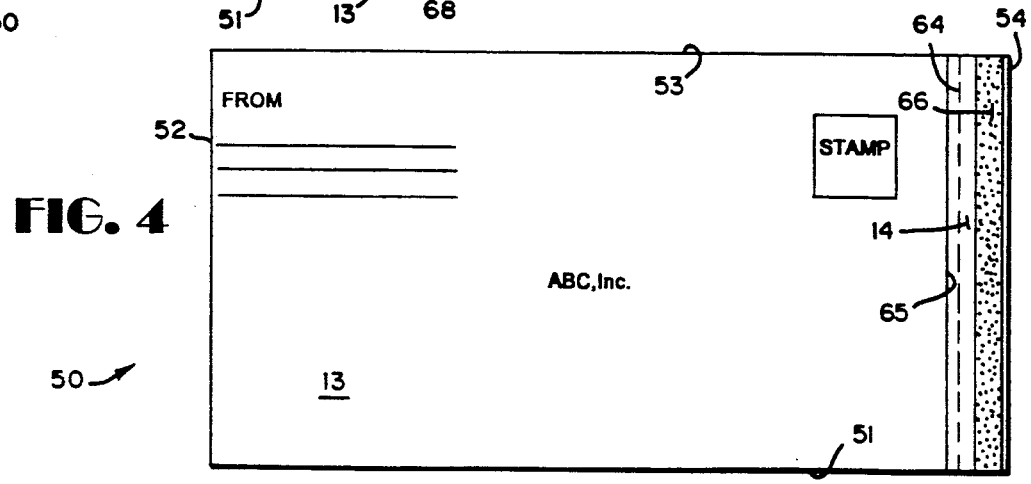
FIG. 4

METHOD OF MAKING A MAILER WITH TEAR STRIP ON OUTGOING AND RETURN ENVELOPES

BACKGROUND AND SUMMARY OF THE INVENTION

A particularly desirable form of conventional mailer includes a tear strip feature on the outgoing envelope. One particular form of this type of mailer is a ZIP STRIP® mailer such as sold by Moore Business Forms, Inc. of Glenview, Ill. While such a feature is desirable, the return envelope typically does not have an easy opening feature associated therewith. Typically when the addressor of the outgoing envelope receives the return envelopes back, they are opened in such a way that damage to the contents thereof may occur. Normally, a mechanical letter opener is used to access the return envelope, slitting open one edge, again with possible damage to the contents.

According to the present invention, a mailer construction is provided, and a method of continuously making such mailers, wherein the return envelope is also provided with a tear strip. This allows the addressor of the outgoing envelope to also easily access the contents of the envelope returned to it by the addressee of the outgoing envelope, efficient manual removal of the contents of the return envelope without significant possibility for damaging the contents thereof being possible.

According to one aspect of the present invention, a method of continuously constructing mailer type business forms is provided. The method comprises the steps of: (a) Providing first and second sheets of an outgoing envelope, each sheet having first, second, third and fourth edges. (b) Providing first and second sheets for a return envelope, each having first, second, third and fourth edges. (c) Forming a slit in the first sheet parallel to the second edge thereof, and intersecting the first edge thereof, and a perforation adjacent and parallel to the first edge, and intersecting the slit, in each of the outgoing and return envelopes, to provide an easy opening tear strip. (d) Applying adhesive connecting the first and second sheets of the outgoing envelope together at edges thereof, to form an outgoing envelope. And, (e) applying adhesive connecting the first and second sheets of the return envelope together at three edges thereof, leaving one open edge to allow access to the interior of the return envelope. Typically step (c) is practiced by providing the perforation of the tear strip perpendicular to the open edge of the return envelope, and in the bottom sheet of the return envelope, address information being provided on the top sheet of the return envelope. Also the bottom sheet of the return envelope typically is wider than the top sheet of the return envelope, overlapping at the fourth edge thereof, and having adhesive applied to the overlapping portion so that it can be bent back over and adhesively secured to the top sheet of the return envelope.

It is desirable to provide the tear strips in the outgoing and return envelopes parallel to each other, both in the bottom sheets of the respective outgoing and return envelopes. It is also desirable to provide an insert between the top sheet of the outgoing envelope and the top sheet of the return envelope, the insert not being adhesively secured to either envelope. The insert may have an edge portion which is adhesively secured to the outgoing envelope, but there is a die cut or perforation between the edge portion of the insert and the insert so that the insert may be readily removed from the outgoing envelope.

According to another aspect of the present invention a mailer type business form is provided. The business form comprises: An outgoing envelope comprising first and second sheets, each sheet having first, second, third and fourth edges, an adhesive securing the first and second sheets together at edges thereof. A slit formed parallel to and adjacent the second edge and intersecting the first edge, and a perforation disposed adjacent and parallel to the first edge and intersecting the slit, the perforation extending from the slit to essentially the fourth edge, both the slit and perforation being formed in the first sheet of the outgoing envelope to provide an easily openable tear strip. A return envelope disposed within the outgoing envelope, the return envelope formed from first and second sheets each having first through fourth edges, with adhesive attaching three of the edges together but leaving a fourth edge open to allow access to the interior of the return envelope. And, a slit formed parallel to and adjacent the second edge and intersecting the first edge, and a perforation disposed adjacent and parallel to the first edge and intersecting the slit, the perforation extending from the slit to essentially the fourth edge, both the slit and perforation being formed in the first sheet of the return envelope to provide an easily openable tear strip.

It is the primary object of the present invention to provide a mailer type business form with tear strips on both the outgoing and return envelopes. This and other objects of the invention will become clear from an inspection of the detailed description of the invention and from the appended claims.

BRIEF DESCRIPTION OF THE DRAWINGS

FIG. 2 is a bottom plan view, with portions cut away for clarity of illustration, of a typical mailer type business form produced utilizing the apparatus of FIG. 1;

FIG. 3 is a bottom plan view, with portions cut away, of the return envelope of the business form of FIG. 2; and FIG. 4 is a top plan view of the return envelope of FIG. 3.

DETAILED DESCRIPTION OF THE DRAWINGS

Figure 1:
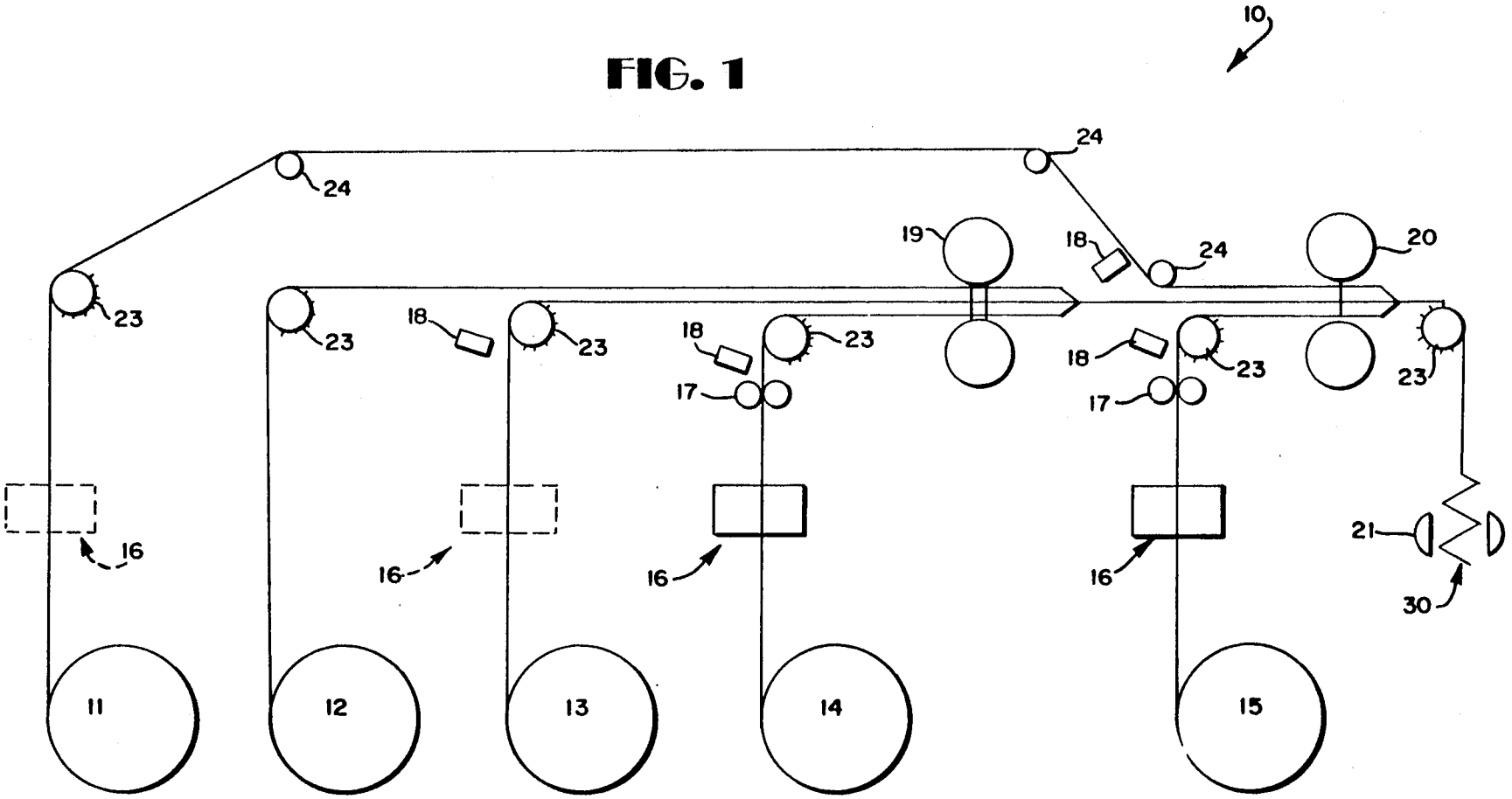
FIG. 1 is a schematic view of apparatus utilized to construct mailer type business forms according to the method of the present invention.

The apparatus 10 illustrated in FIG. 1 is utilized in the method of continuously producing mailer type business form according to the invention, which provide easy opening tear strips in both the outgoing and return envelopes. A roll 11 provides a second sheet for the outgoing envelope, roll 12 provides an insert roll 13 provides a second sheet of the return envelope, roll 14 a first sheet of the return envelope and roll 15 a first sheet of the outgoing envelope Conventional slit and perf units 16 are provided for forming the tear strips in various sheets of the business form being constructed. As illustrated in FIG. 1, the units 16 are provided for forming the slits and perfs for the tear strip in the first sheets of both of the outgoing and return envelopes. However as illustrated in dotted line in FIG. 1, a unit 16 may be provided associated with the sheets 11, 13 instead of the sheets 14 15; or may be associated with the sheets 11, 14, or 13, 15, depending upon the particular mailer being constructed.

The apparatus 10 further comprises conventional pattern pasting units 17 for the outgoing and return envelopes, and conventional vertical pasting units 18. The units 17, 18 apply adhesive at various portions of the continuous sheets 11, 13, 14, and/or 15 so that the outgoing envelope is connected together at all four edges thereof, and the return envelope at three of the four edges thereof. A conventional die cut chip unit 19 is provided associated with the sheets 12 through 14, so as to make the return envelope and insert readily removable from the outgoing envelope. After all of the sheets 11 through 15 have been laid together, a conventional cross perforating unit 20 forms each of the integral elements being constructed into a separate mailer, passing to the folder 21 where they are typically folded for ease of packaging and transport.

Located at various portions within the apparatus 10 are toothed wheels 23 and rollers 24. The toothed wheels 23 typically engage tractor drive portions of the sheets 11 through 15, which tractor drive portions will ultimately subsequently be removed. Regardless, the units 23 and the rollers 24 merely guide the sheets into proper juxtaposition with respect to each other during manufacture.

One of the typical mailer type business forms 30 according to the present invention is illustrated in FIG. 2. The business form 30 has tractor drive edge portions 29 thereof that are connected by perforations to the main body of the mailer, but are removed prior to use—that is prior to actual mailing of the outgoing envelope. The tractor drive portion strips 29 were provided to facilitate construction utilizing the apparatus 10, and also to allow the addressor of the outgoing envelopes to print whatever information is desired on the outgoing envelope, and typically on the insert and return envelope too, utilizing various types of carbon spots, carbonless coatings, or the like on the various sheets. The exact manner of providing carbon spots, carbonless coatings, and the like are conventional, and will depend upon the particular use to which the addressor seeks to put the form 30.

The sheet 15 of the form 30 (as the sheet 11) has a first edge 31, second edge 32, third edge 33, and fourth edge 34, consecutively disposed along its periphery. At the edges 32, 34 perforations are provided to allow ready detachment of the tractor drive strips 29. The top and bottom edges 31, 33 of the form 30 were produced by the perforating unit 20, and originally were connected to other mailers in a continuous strip, but are readily detached at the perforations formed at the edges 31, 33.

An easy opening tear strip feature is provided in the outgoing envelope formed by the sheets 11, 15. As illustrated in FIG. 2, the sheet 15 is shown as the bottom sheet, while the sheet 11 (not shown in FIG. 2) has address information on the outside thereof. However the reverse could also be the case. In the embodiment illustrated in FIG. 2, a slit 36 is formed parallel to and adjacent the second edge 32, and intersecting the first edge 31. A perforation 38 is disposed adjacent the first edge 31, and spaced therefrom and parallel thereto, intersecting the slit 36 and extending all the way to, and preferably intersecting, the fourth edge 34. This slit 36 and perforation 38 arrangement provides a tear strip 39, which has an edge 40 originally defined by the slit 36 that can be grasped by the user and pulled to the right as viewed in FIG. 2, causing the strip 39 to detach at the perforation 38 from the sheet 15.

As can be seen in FIG. 2, the outgoing envelope preferably has the sheets 11, 15 adhesively connected together at all four edges thereof. For example adjacent the edge 31 adhesive strip 42 connects the sheets 15, 11, and like strips 44, 45, 46 connect the sheets 15, 11 together adjacent the second through fourth edges respectively thereof. The adhesive connection 42 is not substantial, merely being a pattern adhesive type arrangement, so that the tear strip 39 may readily be detached from the top sheet 11. All parts are preferably pasted together. For example, at least the three parts (including the insert 12) are pasted to the outgoing envelope at the left and right.

Disposed within the outgoing envelope 11, 15 of the business form 30 is the return envelope 50, connected to the outgoing envelope but readily detachable therefrom, and the insert 12.

The return envelope 50, as most clearly seen in FIGS. 3 and 4, has first, second, third, and fourth edges 51 through 54, respectively, of the first sheet 14 thereof, which preferably is the bottom sheet, the top sheet 13 having address information formed thereon as seen in FIG. 4. Adjacent to the second edge 52 and parallel thereto, and intersecting the third edge 53, is the slit 56 comparable to the slit 36 in the outgoing envelope. The perforation 57 is spaced from and parallel to the third edge 53 and preferably intersects the perforation 64, being comparable to the perforation 38 in the outgoing envelope. Thus a readily detachable tear strip 61 is provided, of the type included in the ZIP STRIP® mailer slot by Moore Business Forms, Inc. of Glenview, Ill. Note that the edge 58 of the tear strip 61 is formed at the slit 56 and may be grasped to allow the strip 61 to be detached by a leftward movement (as viewed in FIG. 3). Also, indicia may be provided, such as the indicia 59 indicating "lift", and the indicia 60 indicating "tab" and directions for pulling the tab to detach the tear strip 61.

For the return envelope 50, adhesive 62, 68, 69 is provided connecting three of the four edges of the bottom sheet 14 and top sheet 13 together. The adhesive 62 is preferably a patterned adhesive to allow ready detachment of the tear strip 61 from the top sheet 13 when the tear strip 61 is removed.

The return envelope 50 also preferably is constructed so that the bottom sheet 14 is wider than the top sheet 13. The top sheet 13 has the fourth edge 65 thereof inwardly spaced from the fourth edge 54 of the bottom sheet 14. Preferably a perforation 64 is provided at the overlapping portion of the bottom sheet 14, and wettable adhesive 66 or the like is provided on the overlapping portion so that it may be bent over at the perforation 64 and adhesive 66 brought into contact with the top sheet 13 thereby adhesively securing the return envelope 50 after the check, or other paper, is inserted into the open end (at the fourth edges 54, 65) of the return envelope 50. Note that at the second edge 52 adhesive 69 connects the sheets 13, 14 together while at the first edge 51 and third edge 53 the adhesive 68 and 62 connects the sheets 13, 14 together.

The mailer 30 according to the present invention is easy to construct and utilize. When the outgoing envelope formed by the sheets 15, 11 is mailed out, the addressee—to gain access thereto —merely grabs the edge portion 40 of the tear strip 39, and pulls rightwardly (in FIG. 2) exposing the return envelope 50 and the insert 12. The insert 12 and return envelope 50 are readily removed from the interior of the outgoing envelope [they need not be adhesively secured thereto, but may be secured thereto by a die cut or perforations 49]. After the addressee inserts whatever documents or things need be inserted into the open end at the fourth edge 54, 65 of the return envelope 50, the overlapping portion at the fourth edge is folded at perforation 64 and adhesively secured by adhesive 66 to the top sheet 13 of the return envelope 50. The return envelope 50 is then mailed back to the original addressor by the original addressee.

When the original addressor receives the return envelope 50 the contents thereof are readily manually removed merely by an operator grabbing the tab edge 58 and pulling to the left (as illustrated in FIG. 3), detaching the tear strip 61 from the bottom sheet 14 of the return envelope 50. This exposes the interior contents of the envelope 50 without the possibility of damage to the interior components thereof, allowing quick and effective removal thereof.

The tear strip feature may be positioned adjacent either first edge 31 or third edge 33 on sheet 11 or 15 of the outgoing envelope and can be "pulled" to the left or the right. This feature also may be positioned adjacent first sheet edge 51 or third sheet edge 53 on sheet 13 or 14 of the return envelope and can be "pulled" to left or right. Other forms specifications will dictate in which position the tear strip feature will be located.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of continuously constructing mailers comprising the steps of:

(a) providing first and second sheets of an outgoing envelope, each sheet having first, second, third and fourth edges;

(b) providing first and second sheets for a return envelope, each having first, second, third and fourth edges;

(c) forming a slit in said first sheet parallel to said second edge thereof, and intersecting said first edge thereof, and a perforation line adjacent and parallel to said first edge, and intersecting said slit, in each of said outgoing and return envelopes, to provide an easy opening tear strip in each of said outgoing and return envelopes;

(d) applying adhesive connecting said first and second sheets of said outgoing envelope together adjacent and along each of said first through fourth edges thereof, to form an outgoing envelope; and (e) applying adhesive connecting said first and second sheets of said return envelope together at adjacent and along three edges thereof including the first edge, leaving one edge opposite said second edge open to allow access to the interior of said return envelope.

2. A method as recited in claim 1 wherein step (e) is practiced by providing said one end at said fourth edge, opposite said second edge, the perforation formed in step (c) in the return envelope intersecting said fourth edge.

3. A method as recited in claim 2 wherein said first sheet of said return envelope is the bottom thereof and said second sheet is the top thereof, and wherein steps (b), (c), and (e), are practiced to provide the bottom sheet slightly wider than said top sheet so that the fourth edge of said bottom sheet is spaced from the fourth edge of said top sheet; and providing the further steps of applying adhesive to the spaced portion of said fourth edge of said bottom sheet so that when the adhesive is activated and the fourth edge of said bottom sheet folded over it may be adhesively secured to the top sheet of said return envelope thereby closing said open edge thereof.

4. A method as recited in claim 3 comprising the further step of forming a perforation adjacent the fourth edge of said top sheet in said bottom sheet to facilitate bending over of the fourth edge of said bottom sheet to move into adhesive engagement with the top sheet of the return envelope.

5. A method as recited in claim 4 wherein step (c) is practiced so that said perforations in the first sheets of said outgoing and return envelopes are parallel to each other, whereby the tear strips are also parallel to each other.

6. A method as recited in claim 5 wherein step (c) is practiced so that the slit and perforation are formed in the bottom sheet of said outgoing envelope, the top sheet of said outgoing envelope having address information thereon.

7. A method as recited in claim 6 comprising the further step of providing an insert between said second sheet of said outgoing envelope and said second sheet of said return envelope.

8. A method as recited in claim 7 wherein said step of providing said insert is carried out by adhesively securing an edge of said insert to said outgoing envelope.

9. A method as recited in claim 1 comprising the further step of forming a perforation adjacent the fourth edge of said top sheet in said bottom sheet to facilitate bending over of the fourth edge of said bottom sheet to move into adhesive engagement with the top sheet of the return envelope.

10. A method as recited in claim 1 wherein step (c) is practiced so that said perforations in the first sheets of said outgoing and return envelopes are parallel to each other, whereby the tear strips are also parallel to each other.

11. A method as recited in claim 10 wherein step (c) is practiced to form said slit and perforation in the bottom sheet of said return envelope, address information being provided on the top sheet of said return envelope.

12. A method as recited in claim 11 wherein step (c) is practiced so that the slit and perforation are formed in the bottom sheet of said outgoing envelope, the top sheet of said outgoing envelope having address information thereon.

13. A method as recited in claim 1 comprising the further step of providing an insert between said second sheet of said outgoing envelope and said second sheet of said return envelope.

14. A method as recited in claim 13 wherein said step of providing said insert is practiced by securing an edge of said insert to the outgoing envelope.

* * * * *